US006370733B2

(12) United States Patent
Paton et al.

(10) Patent No.: US 6,370,733 B2
(45) Date of Patent: Apr. 16, 2002

(54) DOOR CHECK DEVICE

(75) Inventors: Gordon A. Paton, Holland Landing; Trevor Rossi, Toronto, both of (CA)

(73) Assignee: Ventra Group Inc., Bradford (CA)

( * ) Notice: Subject to any disclaimer, the term of this patent is extended or adjusted under 35 U.S.C. 154(b) by 0 days.

(21) Appl. No.: 09/733,955

(22) Filed: Dec. 12, 2000

Related U.S. Application Data

(63) Continuation-in-part of application No. 09/369,317, filed on Aug. 6, 1999, now abandoned.
(60) Provisional application No. 60/095,693, filed on Aug. 7, 1998.

(51) Int. Cl.[7] ..... E05C 17/18
(52) U.S. Cl. ..... 16/86 C; 16/82; 292/266; 292/262
(58) Field of Search ..... 16/82, 86 C, 86 A, 16/86 B, 255, 286, 97, 333, 334; 292/266, 262, 278, 265

*Primary Examiner*—Anthony Knight
*Assistant Examiner*—Mark Williams
(74) *Attorney, Agent, or Firm*—Pillsbury Winthrop LLP

(57) ABSTRACT

The present invention relates to a door check device comprising first and second link member engaging structures and a housing. The engaging structures engage opposing face surfaces of an elongated link member. The first engaging structure and the first opposing face surface are configured so as to engage with one another in a first transverse movement restricting relationship and the second engaging structure and the second opposing face surface are also so configured. The engaging structures each are constructed and arranged such that, when the link member is caused to undergo a yaw movement along a yaw plane, the engaging structures are allowed to move along with the link member to thereby facilitate the first and second engaging structures remaining engaged with the first and second face surfaces in the aforesaid first and second transverse movement restricting relationships, respectively.

21 Claims, 10 Drawing Sheets

DOOR CHECK DEVICE

The present application claims priority as a continuation-in-part to U.S. patent appln. of Paton et al., Ser. No. 09/369,317 filed on Aug. 6, 1999, now abandoned, the entirety of which is hereby incorporated into the present application by reference, which in turn claims priority to U.S. Provisional Appln. of Paton et al., Ser. No. 60/095,693, filed Aug. 7, 1998, the entirety of which is hereby incorporated into the present application by reference.

FIELD OF THE INVENTION

The present invention relates to a door check device for installation between a motor vehicle body and a motor vehicle door.

BACKGROUND OF THE INVENTION

Door check devices are well-known in the art for use in checking the swinging motion of automotive doors. These devices generally comprise a link member with one or more sets of detents and a housing that contains a pair of spring-biased rolling elements. The link member is inserted through the housing so that the rolling elements are engaged in rolling contact with the surfaces thereof under their respective spring biasing. Either the link member or the housing is secured to the door panel and the other is secured to the motor vehicle body. As the door panel is swung open, the link member moves relative to the housing. When the rolling elements are received within a set of detents on the link member, the detents and rolling elements cooperate to maintain the link member and housing against relative movement until a force sufficient to overcome the biasing on the rolling elements and disengage the rolling elements from the detents is applied to the door panel. As a result, the door check device functions to yieldingly maintain the door panel in position based on the cooperation between the rolling elements and the detents.

Alternatively, some prior art door check devices use non-rotatable structures that slidably engage opposing sides of the link member. One or both of these fixed structures may be spring-biased against the link member in a manner similar to the roller-type arrangement mentioned above. For an example of such a device, one may refer to U.S. Pat. No. 5,862,570

All of these types of devices typically suffer from two major drawbacks. The first such drawback is that the link member may be allowed to move transversely with respect to the rollers and the housing. This may create unwanted noise during opening and closing of the vehicle door panel. Specifically, such transverse movement may cause the link member to strike or rub against the housing during door opening and closing, thereby creating such unwanted noise. The second such drawback is that the link member may be allowed to pivot or otherwise shift or move relative to the housing in a yaw-type movement. As a result of such movement, the transverse detents can become misaligned with respect to the orientation of the rollers. This misalignment may cause the door check device to become inoperable because the rollers are unable to be received within the detents.

Consequently, there exists a need for an improved door check device that obviates the shortcomings associated with the prior art door check devices discussed above.

SUMMARY OF THE INVENTION

It is therefore an object of the present invention to meet the need expressed above. To achieve this object, the present invention provides a door check device comprising a first and second link member engaging structure and a housing. An elongated link member has a first opposing end that provides a connecting portion, a second opposing end, and an intermediate portion that extends between the first and second opposing ends thereof and provides first and second opposing face surfaces. The intermediate portion has first and second detent regions that extend generally in a transverse direction of the link member on the first and second opposing face surfaces thereof, respectively. The elongated link member is positioned between the first and second engaging structures with the first and second engaging structures extending generally in the transverse direction of the link member such that the first and second rollers face the first and second face surfaces, respectively, of the intermediate portion. Biasing structure is constructed and arranged to bias the first and second engaging structures relatively towards one another to thereby urge the engaging structures into engagement with the first and second opposing face surfaces of the intermediate link member portion, respectively. The connecting portion of the elongated link member and the connecting portion of the housing are constructed and arranged to enable installation of the door check device by operatively connecting one of the connecting portions to the vehicle door and operatively connecting the other of the connecting portions to the vehicle body so that opening and closing movements of the vehicle door relative to the vehicle body moves the link member relative to the housing with the first engaging structure travelling along the first face surface of the link member's intermediate portion and the second engaging structure travelling along the second face surface of the link member's intermediate portion. The engaging structures and the detent regions are configured with respect to one another such that, when the device is installed as aforesaid and the vehicle door is swung to a location with respect to the vehicle body wherein the first and second engaging structures are received within the first and second detent regions, respectively, the first and second engaging structures cooperate with the first and second detent regions to maintain the vehicle door at that position until a force sufficient to cause the link member to move relative to the housing so as to urge the engaging structures relatively apart from one another and out of cooperation with the detent regions against the biasing of the biasing structure is applied to the vehicle door.

The first engaging structure and the first opposing face surface of the intermediate portion are configured so as to engage with one another under the biasing of the biasing structure in a first transverse movement restricting relationship wherein the first opposing face surface and the first engaging structure cooperate to restrict relative movement between the first engaging structure and the link member generally in the transverse direction of the link member. The second engaging structure and the second opposing face surface of the intermediate portion are configured so as to engage with one another under the biasing of the biasing structure in a second transverse movement restricting relationship wherein the second opposing face surface and the second engaging structure cooperate to restrict relative movement between the second engaging structure and the link member generally in the transverse direction of the link member. The first engaging structure and the second engaging structure each are constructed and arranged such that, when the link member is caused to undergo a yaw movement relative to the housing generally along a yaw plane that extends in both the transverse direction and the longitudinal extent of the link member, the first and second engaging structures are allowed to move along with the link member to thereby facilitate the first and second engaging structures remaining engaged with the first and second face surfaces in the aforesaid first and second transverse movement restricting relationships, respectively.

In a preferred embodiment of the invention, the first engaging structure and the first opposing face surface of the intermediate portion have complementary shapes configured so as to engage with one another under the biasing of the biasing structure in a first complementary relationship so as to provide the first transverse movement restricting relationship and the second engaging structure and the second opposing face surface of the intermediate portion have complementary shapes configured so as to engage with one another under the biasing of the biasing structure in a second complementary relationship so as to provide the second transverse movement restricting relationship. However, the broader aspects of the invention are not intended to be limited to such an arrangement.

Other objects, features, and advantages of the present invention will become apparent from the following detailed description, the accompanying drawings, and the appended claims.

DETAILED DESCRIPTION OF THE PREFERRED EMBODIMENT OF THE INVENTION

Figure 1:
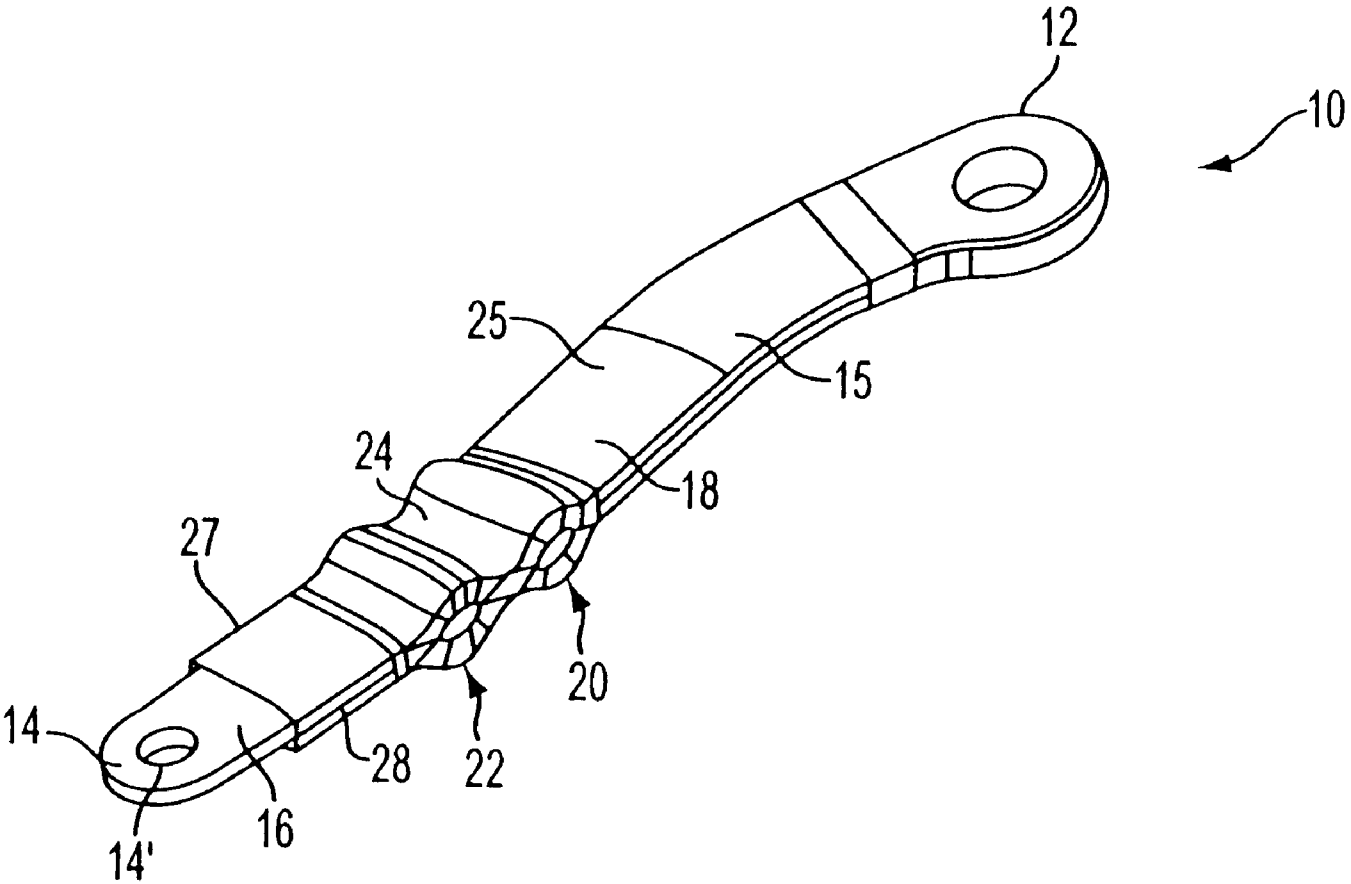
FIG. 1 is a perspective view of a link member.

FIGS. 1–6 illustrate various aspects of one illustrated embodiment of the present invention. FIG. 1 shows a link member 10 which comprises a head portion 12 at a first opposing end thereof and a stop pin portion 14 at a second opposing end thereof comprising an opening 14' through which a stop pin is placed. Link member 10 comprises a steel core 16 coated with a durable low-friction coating such as MINLON™, a mineral-filled nylon provided by Dupont Corporation. An intermediate portion 15 of the link member 10 is defined between the first and second opposing ends thereof. A first swelled portion 20 and a second swelled portion 22 are formed adjacent each other, and each comprise a central axis that extends generally in a transverse direction of the link member 10. More specifically, the first and second swells 20, 22 each have a larger cross-sectional size than the remainder of the link member's intermediate portion and cooperate to form lateral detent regions 24 therebetween. Each side of first swell 20 and second swelled portion 22 protrudes from the first and second opposing face surfaces 25, 26 of link member 10.

The thickness of the link member's intermediate portion 15 is a maximum in the center and gradually decreases toward each lateral side edge thereof 27, 28. That is, each face surface 25, 26 has a configuration that is curved about the longitudinal axis of the link member 10. In the illustrated embodiment, head portion 12 comprises an opening which may be pivotally connected to the body of the vehicle. The stop pin serves to limit relative movement between the link member 10 and the housing, thereby defining a maximum open position for the vehicle door. The functions of each of the first end 12 and second end 14 could be reversed, whereby the first end passes through the opening in the housing, and the second end is pivotally connected to the vehicle body.

Figure 2:
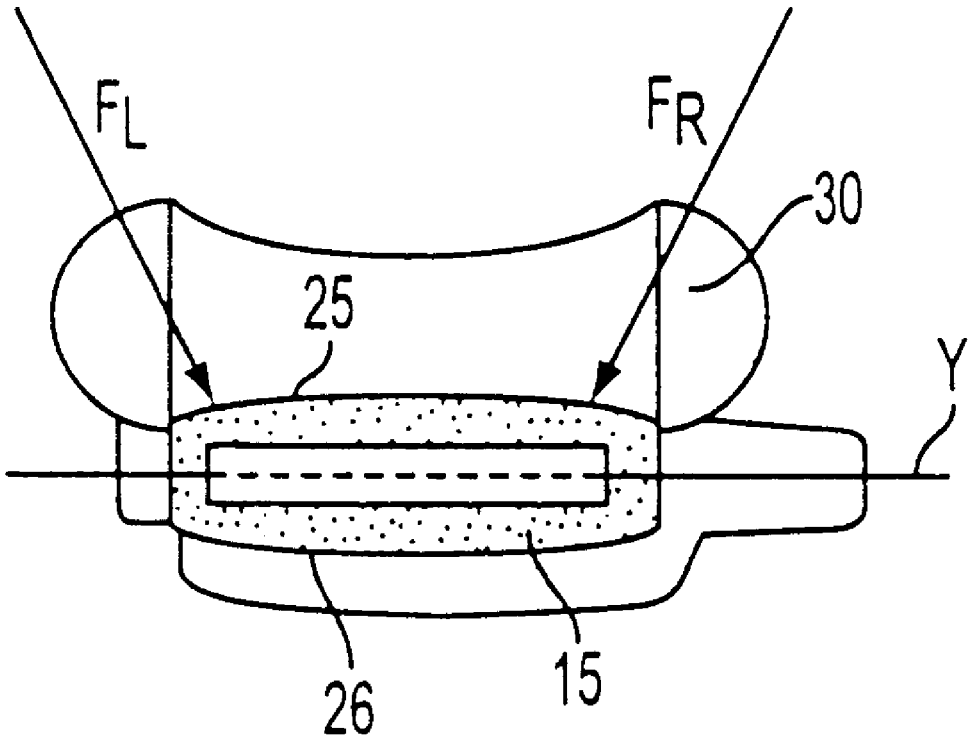
FIG. 2 provides an end view of a link member in contact with an upper roller.

As is better illustrated in FIG. 2, both upper surface 25 and lower surface 26 of link member 10 are each curved, i.e., convex in cross section, so as to maintain a constant curve throughout the length of link member 10. These curved surfaces 25, 26 which will interface with and contact complementary concave contacting surfaces of link member engaging structures. In the embodiment of FIGS. 1–6, the link member engaging structures comprise first and second rollers 30*a*, 30*b* mounted to first and second roller carriers 34*a*, 34*b*, respectively. The scope of the present invention, however, is not limited to rotatable rollers for the link member engaging structures and may encompass any suitable arrangement.

As can be noted from FIG. 1–2, the rollers 30 each have an hourglass-type configuration and rotate about respective rotational axes, which are generally parallel to the transverse direction of the link member 10. Also, each of the rollers 30 has a generally circular cross-section taken radially with respect to the rotational axis thereof and a non-circular cross-section taken along the rotational axis thereof. These rollers 30 are biased to remain in contact with each of the upper surface 25 and lower surface 26 of link member 10 with the use of a biasing structure that comprises a pair of biasing elements in the form of springs 31, 32 contained within the housing. These springs contact the roller carriers 34*a*, 34*b* to affect the biasing of the rollers 30*a*, 30*b*. As a result of this biasing, each roller 30 will exert a force F near both the left lateral side 27 and the right lateral side 28 of link member 10. Each force vector $F_L$, $F_R$ will create a respective lateral/horizontal component $F_{L\text{-}X}$ and $F_{R\text{-}X}$ which will counteract and thus inhibit link member 10 from changing its lateral position relative to housing 38 (see FIG. 5). In other words, the rollers 30 and the face surfaces 25, 26 each have complementary shapes that engage with one another under the biasing of the springs 31, 32 in first and second complementary relationships wherein the respective complementary shapes of the first and second face surfaces 25, 26 and the first and second rollers 30 cooperate to restrict relative movement between the rollers 30 and the link member 10 in the link member's transverse direction. This could also be achieved by providing the rollers 30 with ovoid shapes and providing the face surfaces 25, 26 with convex configurations.

The invention is not intended to be limited to complementary relationships per se and may encompass any type of engaged relationship that tends to restrict relative transverse movement between the link member 10 and the link member engaging structures. These types of relationships may be broadly referred to as transverse movement restricting relationships. However, a complementary relationship is preferred because it provides for a smooth and relatively quiet interaction between the link member 10 and the engaging structures.

It is not necessary to use a pair of compression springs as the biasing structure to urge the link member engaging structures relatively towards one another and into engagement with the opposing face surfaces 25,26 of the link member 10. A single torsion or compression spring could be used to bias one link member engaging structure relative to the other engaging structure, which remains unbiased and may be fixed against movement toward and away from the link member 10. Also, a single compression or torsion spring could have each of its ends biasing a respective one of the link member engaging structures relative to one another and into engagement with the opposing face surfaces of the link member 25,26.

Figure 3A:
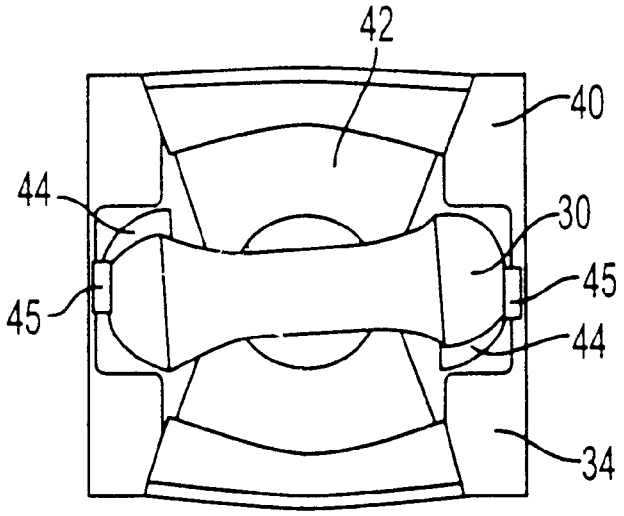
FIGS. 3A and 3B each provide top views of a roller contained in a roller retainer.
Figure 3B:
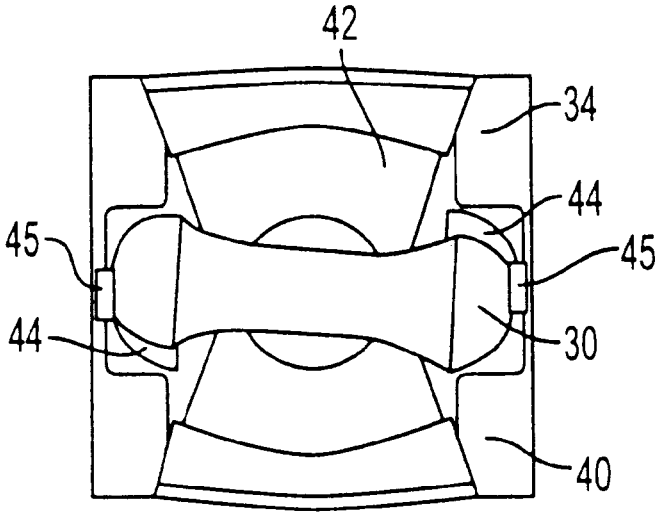
Figure 4:
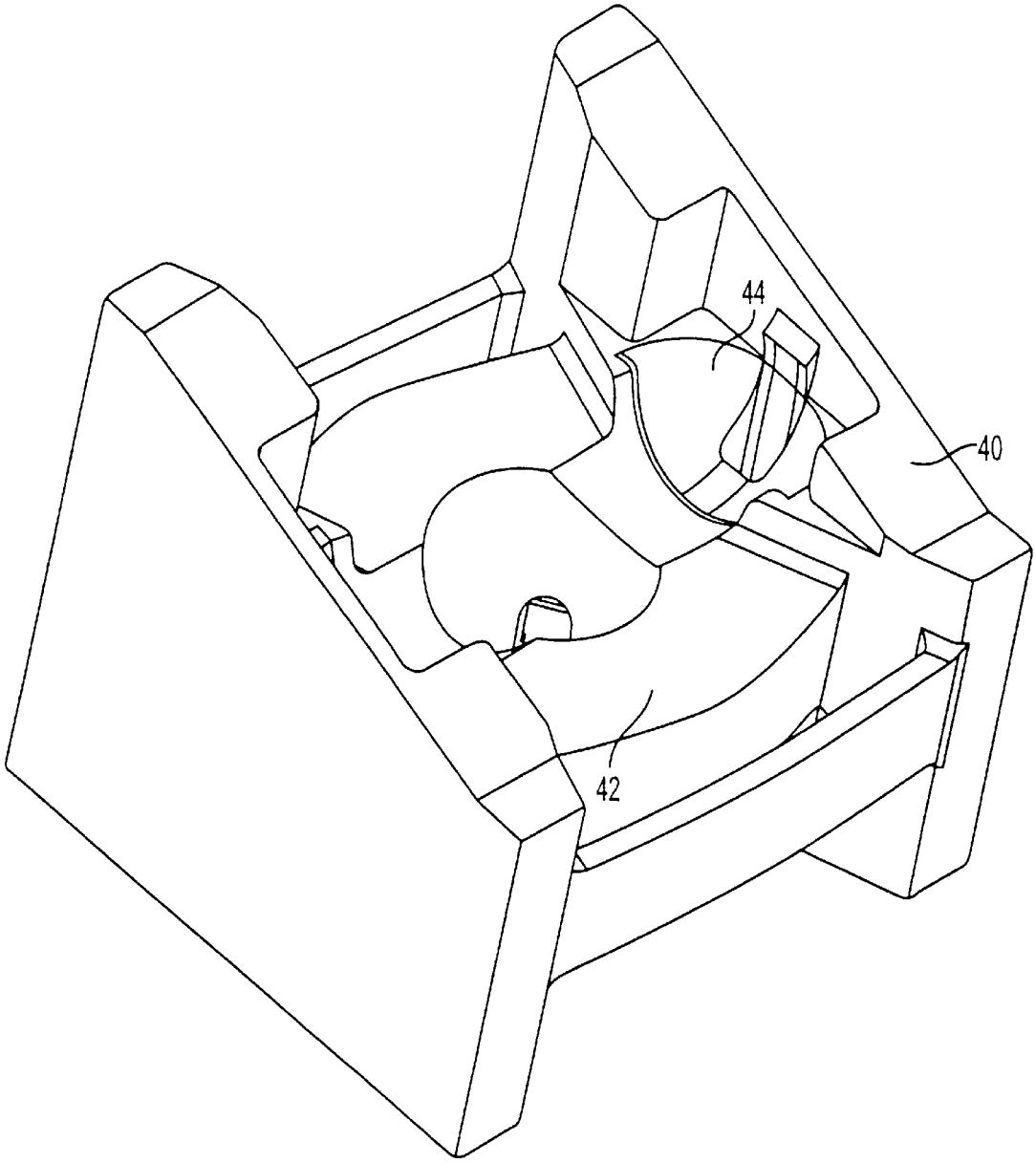
FIG. 4 provides a perspective view of a roller retainer.
Figure 6:
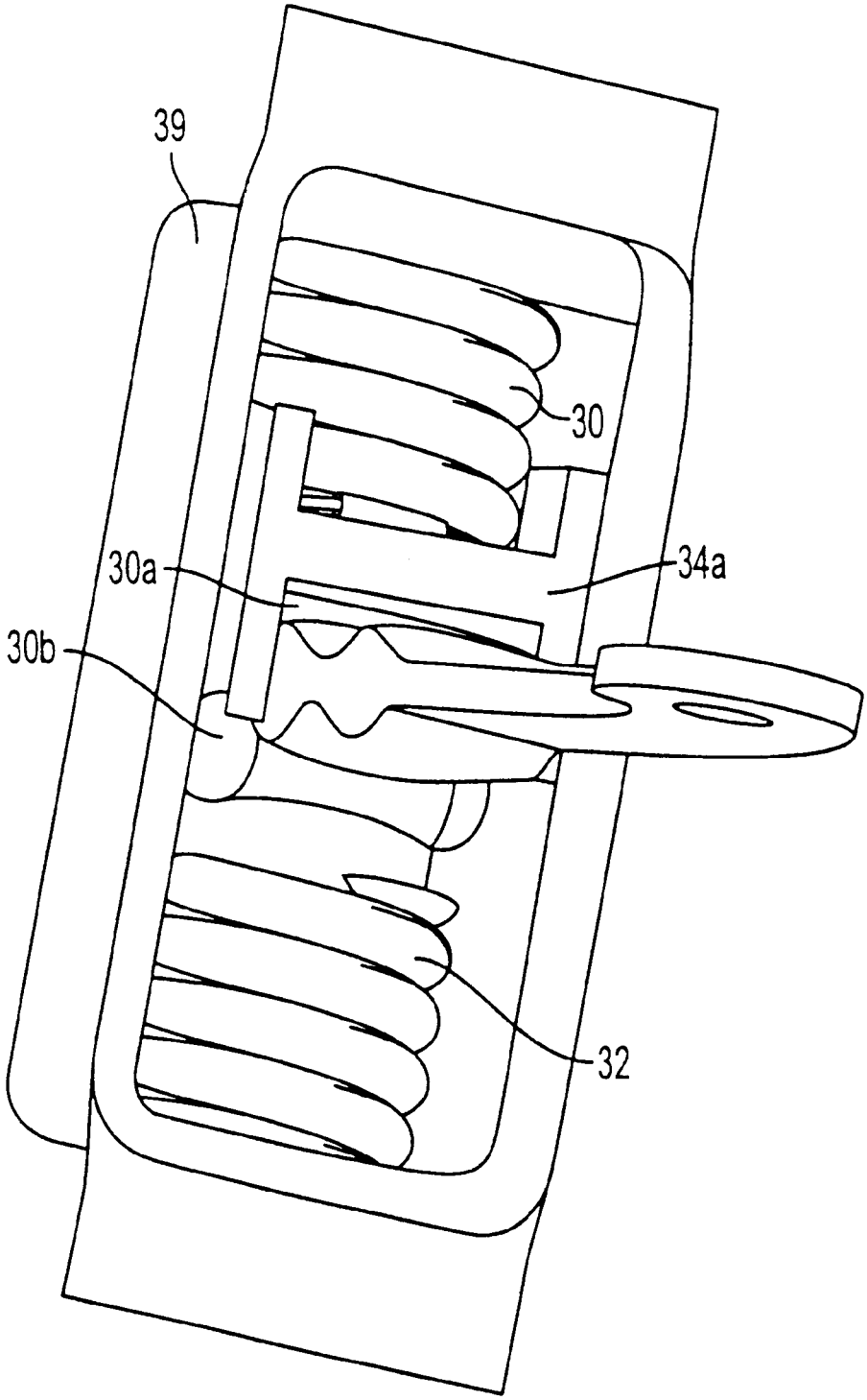
FIG. 6 illustrates a housing case with a partially assembled door check assembly.

FIG. 6 provides a view of a housing case 39, which forms part of housing 38. The housing 38 contains the upper and lower springs 31, 32 that respectively bias the roller carriers 34 to urge the first and second rollers 30*a*, 30*b* into rolling engagement with the first and second opposing face surfaces 25, 26 of the link member's intermediate portion 15. As a result of this rolling engagement, the first and second rollers 30 rotate about the respective first and second rotational axes thereof as the link member 10 is moved relative to the housing 38. As shown in FIG. 6, a first roller carrier 34*a* is provided in the housing 38. A second roller carrier 34*b* (not shown) has been removed to allow a better view of second roller 30*b*. Each roller carrier 34*a*, 34*b* has a spring bearing portion which contacts a spring and thus serves as a platform/perch for the spring to sit on as well as a roller mounting portion for mounting each corresponding roller 30*a*, 30*b*. FIGS. 3A–3B and 4 further illustrates the structure of the roller retainer 34 provided in the illustrated embodiment in closer detail.

As shown in FIGS. 3A–3B and 4, each roller carrier 34 comprises an outer frame portion 40 and a platform/perch 42. Provided in each of the thicker lateral side portions of outer frame portion 40 are a first pair of concave recesses 44 and retaining clips 45. Each roller 30 comprises a central portion having a circular cross section which has a minimum diameter at the center of the roller and gradually increases to a maximum diameter at an end portion at either end of the roller. Rounded end portions are provided at either end of each roller, and sit within a respective concave recess 44 of roller retainer 34 confined in the vertical direction by a retaining clip 45. The other roller carrier has a similar or identical construction.

Retaining clips 45 comprise resilient flexible members which are movable so that roller 30 can be installed into and removed from roller retainer 34 in a snap-fit type manner. These recesses 44 have dimensions which permit a yaw rotation of roller 30 with its opposing ends sliding along the interior surface of its concave recess 44. In FIG. 3A, roller 30 is rotated to its counter-clockwise yaw limit, and in FIG. 3B roller 30 is rotated to its clockwise yaw limit. This permits roller 30 to be maintained in proper alignment with its respective upper or lower surface 25, 26 of link member 10 as the curved cam lateral sides 27, 28 of link member 10 cause the relative yaw position of housing 38 (and the roller retainers 34 contained therein) to change with respect to the link member 10 that is passing through housing 38.

The term "yaw" in the context of the present subject matter is used to describe the movement that the link member 10 may undergo relative to the housing 38 generally along a yaw plane indicated at Y in FIG. 2 that is defined as extending along both the transverse direction and the longitudinal extent of the link member 10. This yaw movement of the link member 10 can occur as a result of inconsistencies between the curvature of the link member 10 and the path along which the door panel swings. Also, this movement can occur as a result of free play being permitted between the portions that connect the housing and the link member to the vehicle body and the door panel. By allowing the rollers 30 to move along with the link member 10 in its yaw movement, the rollers 30 can remain in their respective movement restricting (and preferably complementary) relationships with the first and second face surfaces 25, 26. Additionally, the detent regions will not become misaligned with respect to the rollers 30.

Figure 5:
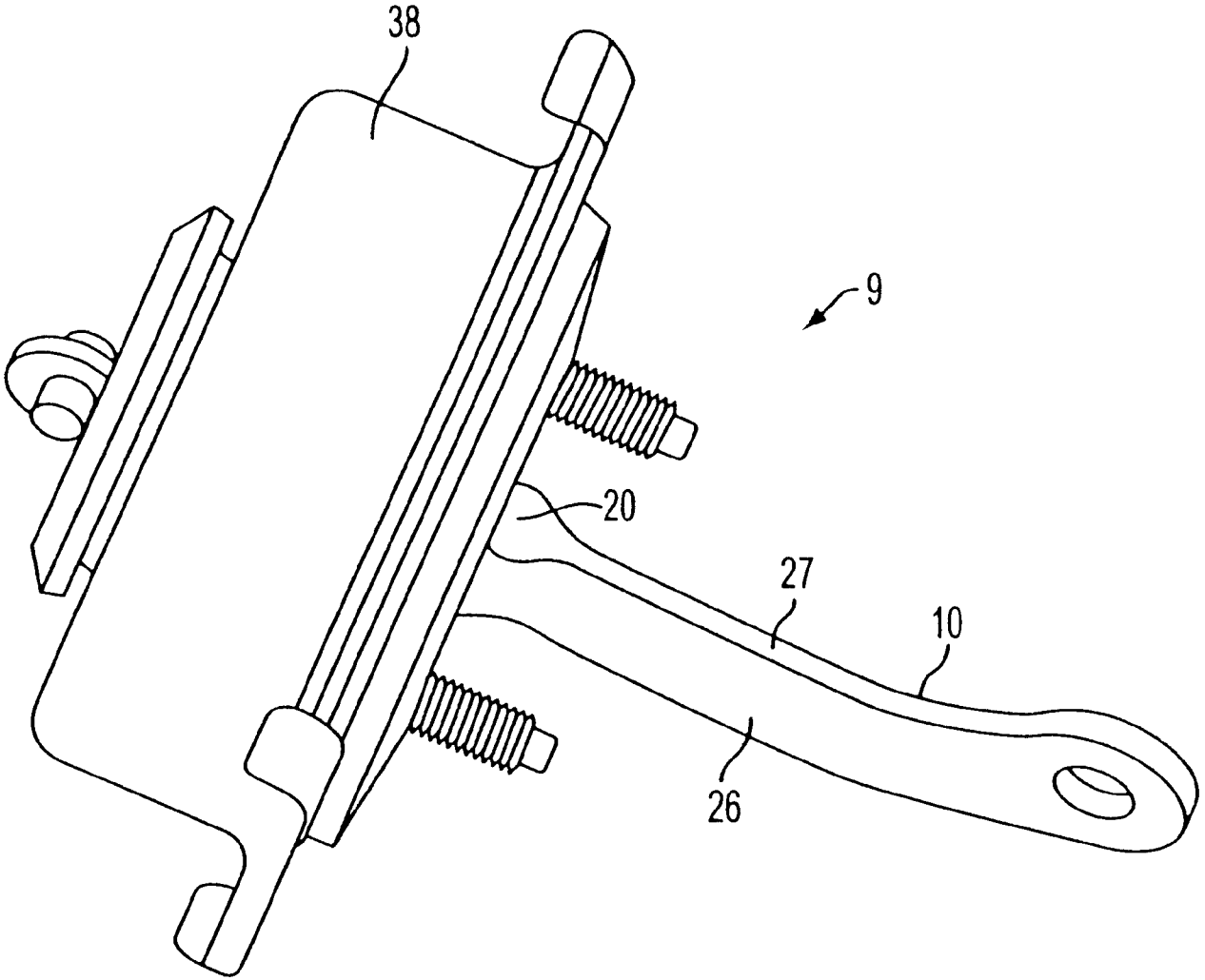
FIG. 5 provides a perspective view of a door check mechanism comprising a link member passing through a housing.

FIG. 5 illustrates an assembled door check device 9 which will check the closing position of a closing member (e.g., a door—not shown) in relation to a frame (e.g., a frame portion of a motor vehicle body—not shown). The door check device 9 comprises a housing 38 which may be affixed either to the closure member or to the vehicle body, and is provided with an opening through which link member 10 is passed. The portions of link member 10 viewable in FIG. 5 include a left lateral side surface 27, a lower surface 26, and a portion of first swell 20, which is partway within the opening of housing 38.

As link member 10 passes through housing 38, rollers 30 will roll and as the curved (cam) configuration of link member 10 passes through housing 38, rollers 30 will accommodate any relative yaw movement of the link member 10 by turning in corresponding yaw movements along with the link member 10 in the manner shown in FIGS. 3A–3B. While rotating in the yaw direction, rollers 30 stay biased against the convex upper and lower surfaces 25, 26 of link member 10, and thus continue to prevent unwanted lateral movement of link member with respect to housing 38 and the noise that may result therefrom.

The radii of curvature of the upper and lower detents formed between swells 20 and 22 should be designed so that they create a sufficient desired resistance force to prevent a door from closing past a certain point absent a force exceeding a desired threshold.

Roller retainers 34 should be formed by a sufficiently rigid and durable material, such as a nylon composition. By way of example, in the illustrated embodiment roller retainers comprise DELRIN™, a nylon 6/6 material produced by Dupont Corporation. Rollers 30 of the illustrated embodiment are formed of steel. They may be formed by any other appropriate rigid, durable, and low-friction material.

One specific embodiment is illustrated in FIGS. 1–6. Various modifications may be made within the spirit of the invention. For example, either the top or lower surface 25 or 26, or both, may be formed to be concave in a manner that compliments a convex configuration of rollers.

Figure 7:
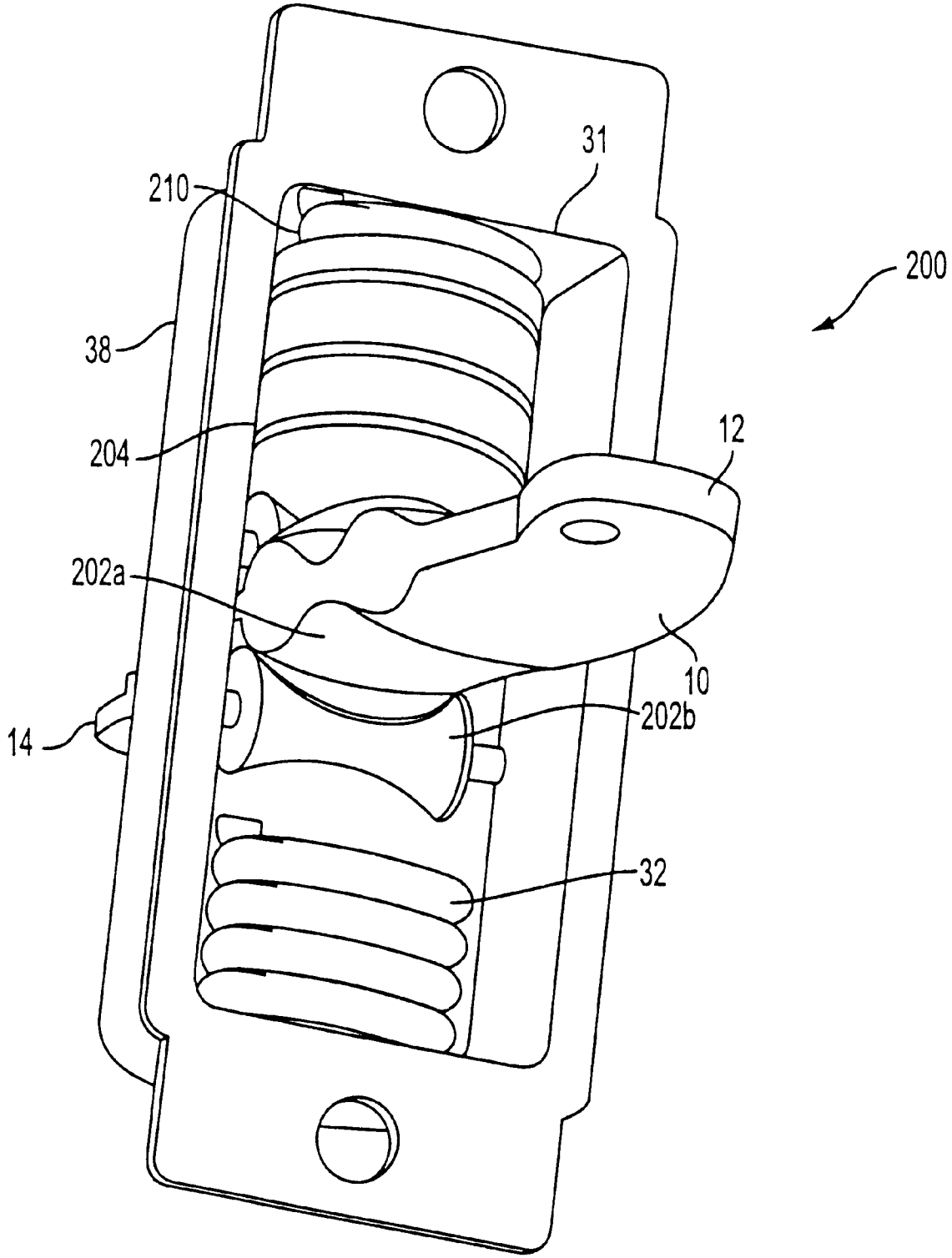
FIG. 7 shows a perspective view of an alternative embodiment of the door check device of the present invention with the carrier of the lower link member engaging structure thereof removed.
Figure 8:
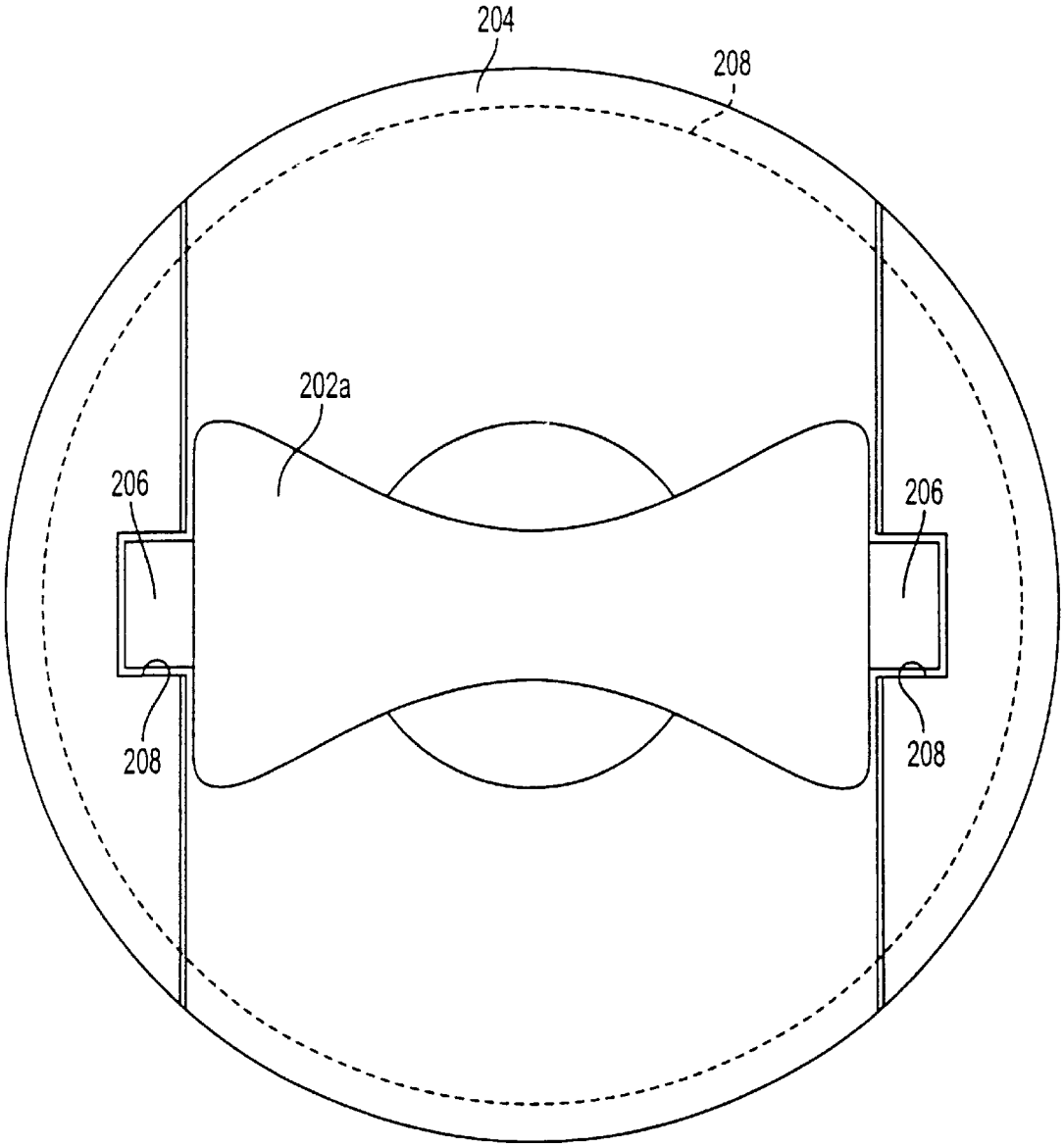
FIG. 8 is a plan view of one of the link members engaging structures of the embodiment of FIG. 7.

FIGS. 7 and 8 illustrate one alternative embodiment constructed in accordance with the principles of the present invention. In this embodiment, the door check device 200 has a similar construction to the device 9 shown in FIGS. 1–6, and thus the same reference numerals will be used to denote corresponding structures.

In the device 200 of FIGS. 7 and 8, the link member engaging structures also comprise hour-glass shaped rollers 202*a*, 202*b* and molded roller carriers, only one of which is shown at 204. The rollers 202*a,* 202*b* rotate about their respective axes relative to the carriers 204, but do not otherwise move relative to the carriers 204. The rollers 202*a,* 202*b* have axles 206 formed at opposing ends thereof along the axis of rotation and the roller carriers 204 each have a pair of opposed axle receiving spaces 208 in which the axles 206 are rotatably mounted. The rollers 202*a,* 202*b* do not move relative to the carriers 204 in a yaw-like manner.

The roller carriers 204 are identical to one another and each have a generally cylindrical exterior shape. At the end thereof opposite the rollers 202*a,* 202*b,* each roller carrier 204 has an annular wall 210 surrounding a spring receiving space. The springs 31, 32 are sized so that the exterior periphery of the springs 31, 32 fit in close relation against the interior surface of the annular wall 210. This allows the carrier 204 to rotate relative to the springs 31, 32 to permit the yaw movement of the rollers 202*a,* 202*b* and carriers 204 together during yaw movement of the link member 10.

The interior of the housing 38 may also have a pair of arcuate surfaces (not shown) on opposite sides of the carriers 204 in the transverse direction of the link member 10. These curved surfaces will allow the roller carriers 204 to rotate during the relative link member yaw movement, but will otherwise restrict movement of the carriers 204 relative to the housing 38 (except of course in the biased direction toward and away from the link member of springs 31, 32). However, the invention may be practiced without such arcuate surfaces. In fact, there is a functional advantage to not using such surfaces because then the link member engaging structures will be allowed to move in the transverse direction of the link member 10 to accommodate any transverse shifting movements of the link member 10, thereby keeping the rollers 202*a,* 202*b* in intimate contact with the opposing sides of the link member 10. During such transverse movement of the link member engaging structure, the springs 31, 32 flex somewhat in the transverse direction to permit the corresponding movement of the carriers 204 and rollers 202.

Figure 9:
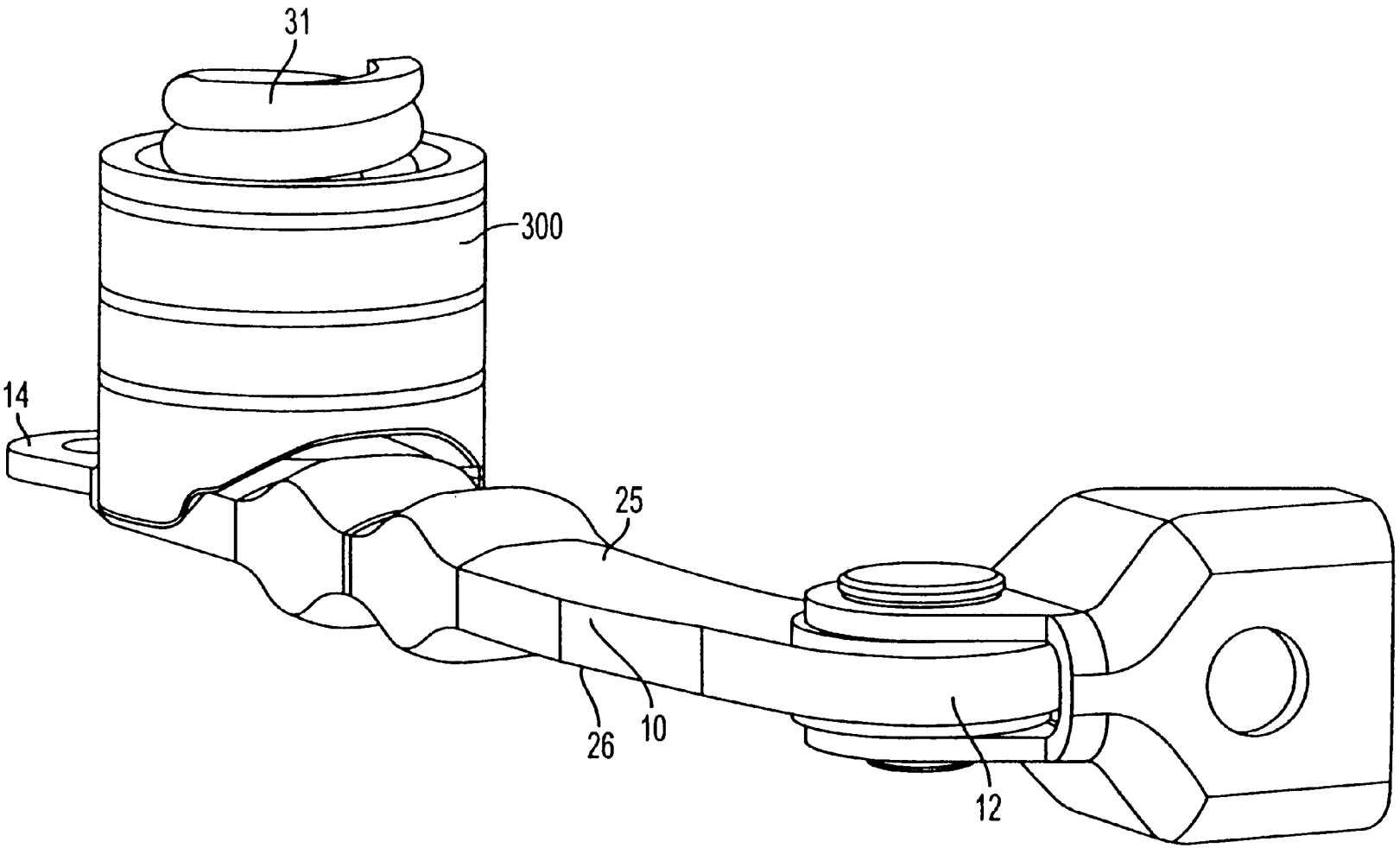
FIG. 9 is a partial view of a second alternative embodiment of the door check device of the present invention with both the housing and the lower link member engaging structure thereof removed for clarity purposes.
Figure 10:
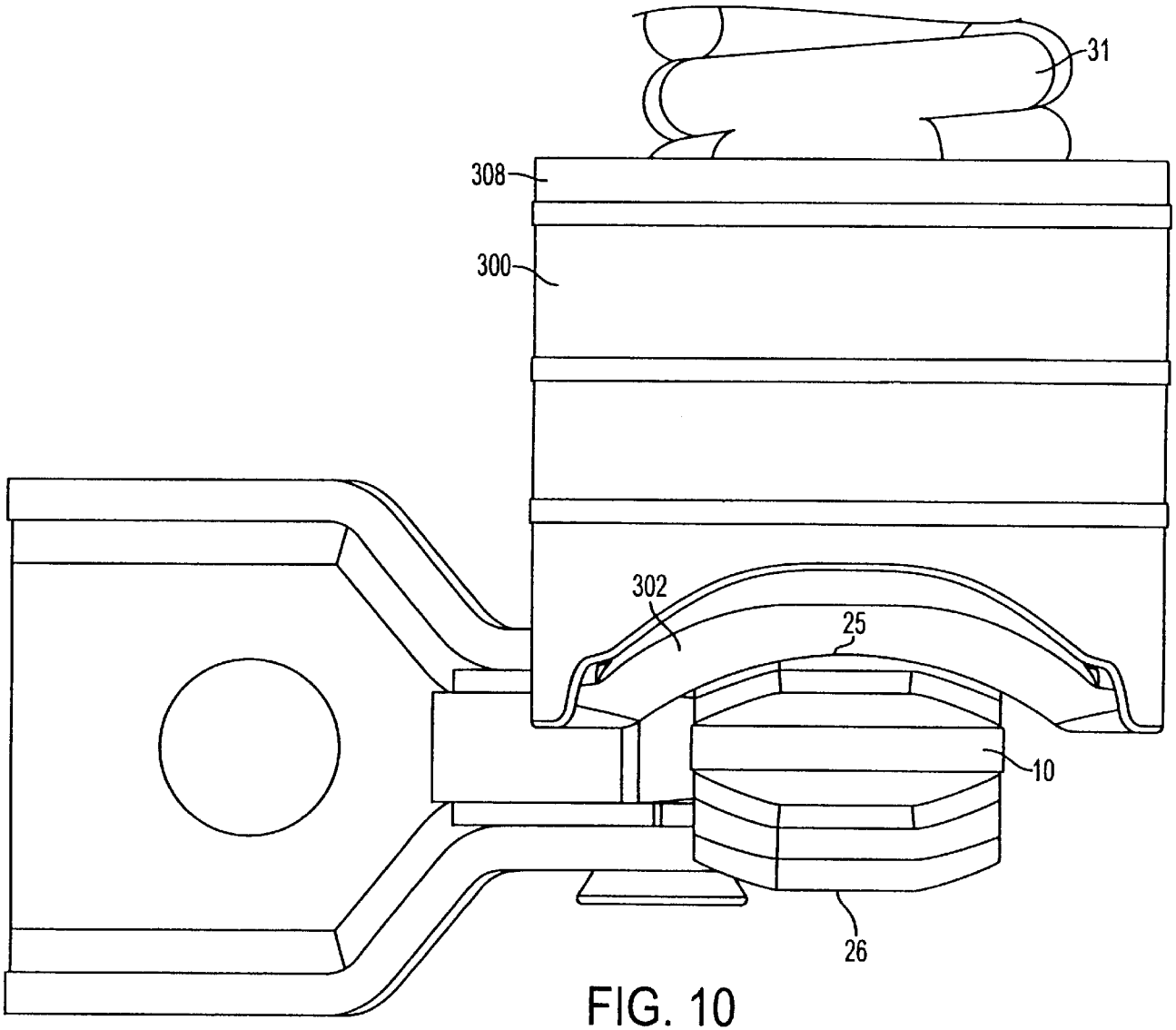
FIG. 10 is a view taken from one end of the link member of the embodiment of FIG. 9.

FIGS. 9 and 10 illustrates yet another alternative embodiment for a door check device encompassing the principles of the present invention. In FIGS. 9 and 10, one of the pair of link member engaging structures, one of the pair of springs 31, 32 comprising the biasing structure, and the link member 10 are illustrated. In this embodiment the rollers and roller carriers are illustrated and each of the link member engaging structures are provided by a generally cylindrical one-piece molded plastic structure 300 that slidably engages the link member 10 instead of rollingly engaging it. As best seen in FIG. 10, slidably engaging structure 300 has an engaging portion 302 that has a concave shape complementary of the convex shape of the opposing surface 25, 26 of the link member 10. The shape of the engaging portion 302 is somewhat similar to the general hour-glass shape of the rollers 30*a,* 30*b,* 202*a,* and 202*b,* but, of course, only the portion thereof that contacts the link member 10 is shaped as such. The advantage of this embodiment is that it is inexpensive to make because it eliminates the need for separately forming and mounting the rollers.

It will thus be understood that the objects of the present invention have been fully and effectively accomplished. The foregoing preferred embodiment has been provided to illustrate the structural and functional principles of the present invention and is not intended to be limiting. To the contrary, the present invention is intended to encompass all modifications, alterations, and substitutions within the spirit and scope of the appended claims.

What is claimed:

1. A door check device for installation between a motor vehicle body and a motor vehicle door that swings in opposing opening and closing directions relative to the vehicle body, said door check device comprising:

a first link member engaging structure;

a second link member engaging structure;

a housing having a connecting portion, an elongated link member having a first opposing end that provides a connecting portion, a second opposing end, and an intermediate portion that extends between said first and second opposing ends thereof and provides first and second opposing face surfaces, said intermediate portion having first and second detent regions that extend generally in a transverse direction of said link member on said first and second opposing face surfaces thereof, respectively;

said elongated link member being positioned between said first and second engaging structures with said first and second engaging structures extending generally in the transverse direction of said link member such that said first and second rollers face the first and second face surfaces, respectively, of said intermediate portion;

biasing structure constructed and arranged to bias said first and second engaging structures relatively towards one another to thereby urge said engaging structures into engagement with the first and second opposing face surfaces of said intermediate link member portion, respectively;

the connecting portion of said elongated link member and the connecting portion of said housing being constructed and arranged to enable installation of said door check device by operatively connecting one of said connecting portions to the vehicle door and operatively connecting the other of said connecting portions to the vehicle body so that opening and closing movements of the vehicle door relative to the vehicle body moves said link member relative to said housing with said first engaging structure travelling along the first face surface of said link member's intermediate portion and said second engaging structure travelling along the second face surface of said link member's intermediate portion;

said engaging structures and said detent regions being configured with respect to one another such that, when said device is installed as aforesaid and the vehicle door is swung to a location with respect to the vehicle body wherein said first and second engaging structures are received within said first and second detent regions, respectively, said first and second engaging structures cooperate with said first and second detent regions to maintain the vehicle door at that position until a force sufficient to cause said link member to move relative to said housing so as to urge said engaging structures relatively apart from one another and out of cooperation with said detent regions against the biasing of said biasing structure is applied to the vehicle door;

said first engaging structure and said first opposing face surface of said intermediate portion being configured so as to engage with one another under the biasing of said biasing structure in a first transverse movement restricting relationship wherein said first opposing face surface and said first engaging structure cooperate to restrict relative movement between said first engaging structure and said link member generally in the transverse direction of said link member;

said second engaging structure and said second opposing face surface of said intermediate portion being configured so as to engage with one another under the biasing of said biasing structure in a second transverse movement restricting relationship wherein said second opposing face surface and said second engaging structure cooperate to restrict relative movement between said second engaging structure and said link member generally in the transverse direction of said link member;

said first engaging structure and said second engaging structure each being constructed and arranged such that, when said link member is caused to undergo a yaw movement relative to said housing generally along a yaw plane that extends in both the transverse direction and the longitudinal extent of said link member, said first and second engaging structures are allowed to move along with said link member to thereby facilitate said first and second engaging structures remaining engaged with said first and second face surfaces in the aforesaid first and second transverse movement restricting relationships, respectively.

2. A door check device according to claim 1, wherein said first engaging structure and said first opposing face surface of said intermediate portion have complementary shapes configured so as to engage with one another under the biasing of said biasing structure in a first complementary relationship so as to provide said first transverse movement restricting relationship and wherein said second engaging structure and said second opposing face surface of said intermediate portion have complementary shapes configured so as to engage with one another under the biasing of said biasing structure in a second complementary relationship so as to provide said second transverse movement restricting relationship.

3. A door check device according to claim 2, wherein said first link member engaging structure comprises a first roller and a first roller carrier and wherein said second link member engaging structure comprises a second roller and a second roller carrier, said first roller being mounted to said first roller carrier for rotation about a first rotational axis that extends generally in the transverse direction of said link member, said second roller being mounted to said second roller carrier for rotation about a second rotational axis that extends generally in the transverse direction of said link member, said first roller and said first opposing face surface of said intermediate portion having complementary shapes so as to engage one another under the biasing of said biasing structure in said first complementary relationship, said second roller and said second opposing face surface of said intermediate portion having complementary shapes so as to engage one another in said second complementary relationship.

4. A door check device according to claim 3, wherein each of said first roller carrier has a pair of first concave recesses and wherein said second roller carrier has a second roller carrier has a second pair of concave recesses, said first roller being mounted within the first pair of concave recesses such that, when said link member is caused to undergo the yaw movement relative to said housing in said yaw plane as aforesaid, the shape of said first pair of concave recesses allows said first roller to move along with said link member with opposing ends of said first roller sliding along the interior surfaces of said first pair of concave recesses, said second roller being mounted within said second pair of concave recesses such that, when said link member is caused to undergo the yaw movement relative to said housing in said yaw plane as aforesaid, the shape of said second pair of concave recesses allows said second roller to move along with said link member with opposing ends of said second roller the interior surfaces of said second pair of concave recesses.

5. A door check device according to claim 4, wherein the opposing ends of said first roller are rounded and wherein the opposing ends of said second roller are rounded.

6. A door check device according to claim 4, wherein said first roller carrier provides a pair of first resilient retaining clips associated with said first pair of concave recesses and wherein said second roller carrier provides a pair of second resilient retaining clips associated with said second pair of concave recesses, said pair of first retaining clips being configured to allow said first roller to be snap-fit into said first roller carrier and to thereafter retain said first roller against removal therefrom;

said pair of second retaining clips being configured to allow said second roller to be snap-fit into said second roller carrier and to thereafter retain said second roller against removal therefrom.

7. A door check device according to claim 4, wherein said first and second rollers each have a larger diameter at end portions thereof than at a central portion thereof so as to provide said rollers each with an hourglass shape and wherein each of said first and second opposing surfaces have a convex shape that complements the hourglass shape of said first and second rollers, respectively, so as to provide the aforesaid first and second complementary relationships.

8. A door check device according to claim 7 wherein said link member is curved along the length thereof.

9. A door check device according to claim 8, wherein said link member is coated with a resilient material.

10. A door check device according to claim 9, wherein said resilient material is MINLON™.

11. A door check device according to claim 4, wherein each concave recess of said first and second pairs of concave recesses are defined along a portion of an imaginary sphere so as to each be partially spherical in shape.

12. A door check device according to claim 3, wherein said first and second rollers are respectively mounted to said first and second roller carriers such that the only substantial relative movement between said rollers and said carriers is rotational movement about said rotational axes.

13. A door check device according to claim 1, wherein said first engaging structure slidably engages the first opposing face surface of said link member intermediate portion and wherein said second engaging structure slidably engages the second opposing face surface of said link member intermediate portion.

14. A door check device according to claim 13, wherein said first engaging structure and said first opposing face surface of said intermediate portion have complementary shapes configured so as to engage with one another under the biasing of said biasing structure in a first complementary relationship so as to provide said first transverse movement restricting relationship and wherein said second engaging structure and said second opposing face surface of said intermediate portion have complementary shapes configured so as to engage with one another under the biasing of said biasing structure in a second complementary relationship so as to provide said second transverse movement restricting relationship.

15. A door check device according to claim 14, wherein each of said first and second engaging structures said engaging portion and said cylindrical portion are integrally molded together as a single plastic piece.

16. A door check device according to claim 14, wherein said engaging portion of each said first and second engaging structures has a concave shape that faces first and second opposing face surfaces of said link member intermediate portion, respectively, and wherein said first and second opposing face surfaces of said link member intermediate portion each have a convex shape complementary to the concave shapes of said respective first and second engaging portions so as to provide the aforesaid first and second complementary relationships.

17. A door check device according to claim 1, wherein said first and second engaging structures are each movable relative to said housing and wherein said biasing structure comprises a first biasing element engaged between said housing and said first engaging structure and a second biasing element engaged between said housing and said second engaging structure.

18. A door check device according to claim 17, wherein said first and second biasing elements are each coil springs.

19. A door check device according to claim 1, wherein said intermediate portion has a first swelled portion and a second swelled portion that are each of a larger cross-sectional size than a remainder of said intermediate portion and spaced apart so as to define said first and second detent regions.

20. A door check device according to claim 19, wherein said second opposing end of said link member has a generally circular bore formed therethrough and wherein said stop member is a generally cylindrical pin inserted through said bore.

21. A door check device according to claim 1, wherein said second opposing end provides a stop member that is configured to engage said housing when said door check device is installed as aforesaid and the vehicle door is being swung in the opening direction thereof so as to limit further relative movement between said link member and said housing, thereby defining a maximum open position for the vehicle door.

* * * * *